US008724776B2

(12) United States Patent
Haas et al.

(10) Patent No.: US 8,724,776 B2
(45) Date of Patent: May 13, 2014

(54) TWO-AXIS SAGITTAL FOCUSING MONOCHROMATOR

(75) Inventors: Edwin G. Haas, Sayville, NY (US); Christopher Stelmach, Holbrook, NY (US); Zhong Zhong, Stony Brook, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 382 days.

(21) Appl. No.: 13/227,517

(22) Filed: Sep. 8, 2011

(65) Prior Publication Data

US 2012/0063569 A1 Mar. 15, 2012

Related U.S. Application Data

(60) Provisional application No. 61/381,639, filed on Sep. 10, 2010.

(51) Int. Cl.
*G21K 1/06* (2006.01)

(52) U.S. Cl.
USPC ..... 378/84; 378/204

(58) Field of Classification Search
USPC ..... 378/84, 85, 204
See application file for complete search history.

(56) References Cited

U.S. PATENT DOCUMENTS

| | | | |
|---|---|---|---|
| 4,637,041 A | 1/1987 | Brinkgreve et al. | |
| 4,649,557 A | 3/1987 | Hornstra et al. | |
| 4,949,367 A | 8/1990 | Huizing et al. | |
| 6,236,710 B1 | 5/2001 | Wittry | |
| 6,259,763 B1 | 7/2001 | Bitter et al. | |
| 6,498,830 B2 | 12/2002 | Wittry | |
| 6,829,327 B1 | 12/2004 | Chen | |
| 7,508,912 B2 | 3/2009 | Zhong et al. | |
| 2008/0247512 A1 * | 10/2008 | Zhong et al. | 378/85 |

FOREIGN PATENT DOCUMENTS

JP 6258497 A 9/1994

OTHER PUBLICATIONS

Yang, W., et al., "Spatially Resolved Poisson Strain and Anticlastic Curvature Measurements in Si Under Large Deflection Bending, " *Applied Physics Letters*, vol. 82, No. 22, pp. 3856 to 3858, 2003.

Zhong, Z., et al., "Sagittal Focusing of High-Energy Synchrotron X-rays with Asymmetric Laue Crystals. I, Theoretical Considerations," *Journal of Applied Crystallography*, vol. 34, pp. 504-509, 2001.

Zhong, Z., et al., "Sagittal Focusing of High-Energy Synchrotron X-rays with Asymmetric Laue Crystals. II Experimental Studies," *Journal of Applied Crystallography*, vol. 34, pp. 646-653, 2001.

* cited by examiner

*Primary Examiner* — Courtney Thomas
(74) *Attorney, Agent, or Firm* — Dorene M. Price

(57) ABSTRACT

An x-ray focusing device and method for adjustably focusing x-rays in two orthogonal directions simultaneously. The device and method can be operated remotely using two pairs of orthogonal benders mounted on a rigid, open frame such that x-rays may pass through the opening in the frame. The added x-ray flux allows significantly higher brightness from the same x-ray source.

20 Claims, 11 Drawing Sheets

TWO-AXIS SAGITTAL FOCUSING MONOCHROMATOR

CROSS-REFERENCE TO RELATED APPLICATIONS

This application claims the benefit of U.S. Provisional Application No. 61/381,639, filed on Sep. 10, 2010, the specification of which is incorporated by reference herein in their entirety for all purposes.

STATEMENT OF GOVERNMENT RIGHTS

This invention was made with Government support under contract number DE-AC02-98CH10886, awarded by the U.S. Department of Energy. The Government has certain rights in the invention.

BACKGROUND

The present device generally provides focusing of divergent high-energy x-rays while maintaining good energy resolution, and more particularly relates to a device and method for bending a monochromator crystal with respect to two orthogonal axes to provide both horizontal and vertical focusing of an x-ray beam.

An x-ray produced at a light source will spread out or diverge as it travels from the light source. X-rays produced by a beamline with a 5 milliradian divergence, for example, will spread to 5 millimeters (mm) by the time they are 1 meter away from their source, and to 50 mm when 10 meters away. This is a problem for light source scientists, who want the highest possible x-ray flux on a small spot.

Previous technologies for x-ray focusing relied on mirror-like surface reflections to focus x-rays. These technologies demonstrated that x-rays can be focused by bending a Bragg crystal. This approach was the first which enabled the use of a synchrotron x-ray beam having a large horizontal divergence. In the years since, the technology has improved to minimize the anticlastic bending which degrades performance of this class of focusing monochromator, but such technologies still required large active surfaces as the x-ray energy increases and/or the grazing incident angle decreases. This requirement causes technical difficulties in error control and there are theoretical limitations on the divergence of the x-rays that can be focused. Moreover, serious theoretical and practical limitations remain, limiting such technologies to low x-ray energies and small x-ray divergence.

For X-rays with energies above 30 keV, the Bragg angle is small and it is difficult to implement traditional bending of the crystal. Because of the decreased Bragg angle, the beam's footprint on the crystal increases. Large crystals, of length approximately 100 mm, must be used, making the control of anticlastic bending difficult, if not impossible. For example, focusing of X-rays from 40 to 60 keV has been recently achieved by combining specialized bender, high-precision cutting of hinged crystals and higher index diffraction to increase the Bragg angle. Also, at high x-ray energies, the energy bandwidth of the monochromatic beam created is dominated by the vertical opening angle of the beam, which is of the order of a few tenths of a milliradian. The resulting energy resolution may be unacceptable for some applications. Finally, the bending radius required becomes extremely small at high x-ray energies, requiring extremely thin crystals, which is impractical for such long crystals.

The recent availability of powerful, third-generation high-energy synchrotron radiation sources, such as the APS in the United States, the ESRF in France, and Spring-8 in Japan, and the availability of superconducting wigglers have pushed the spectrum of x-rays to much higher energies than imaginable two decades ago. Thus, practical methods were needed to focus diverging high-energy x-rays so that these facilities would not be limited to using either lower energy x-rays or a tiny part of the large horizontal fan beam.

Commonly owned U.S. Pat. No. 7,508,912 to Zhong et al., the specification of which is incorporated herein by reference in its entirety for all purposes, discloses an x-ray focusing device utilizing a set of Laue crystals, named for German physicist Max von Laue, to diffract an x-ray beam, as opposed to reflecting the beam. Specifically, the invention described therein uses the lattice planes inside such crystals to monochromatize and focus the x-rays, thus allowing them to be almost perpendicular to the surface of the crystal. The transmission geometry renders the beam's illumination length small, reducing the control of the crystal's figure-error from a two-dimensional problem to a one-dimensional one. This new concept takes advantage of the fact that high-energy x-rays have enough penetrating power to go through the thickness of the Laue crystal.

As a result, the Laue geometry of the crystals provides advantageous anticlastic bending with reduced cost and ease of operation. Moreover, simple linear translation capabilities of the device disclosed in the '912 patent allowed for one-motion tuning of x-ray energy. Therefore, in addition to gains of focusing, an order-of-magnitude increase in the monochromatic intensity could be achieved while providing better energy resolution, compared to existing prior art Bragg crystals.

However, conventional x-ray focusing applications utilizing Laue crystals have thus far involved bending the focusing crystal in only one direction. Specifically, the crystalline structure of silicon (and other materials) selectively allows particular wavelengths of soft x-rays to be deflected at specific angles through the thickness of the crystalline material. Thus, when the crystal is bent laterally, focusing of the soft x-rays results.

In typical conventional x-ray focusing applications, monochromator crystals were generally purchased and/or machined flat. Where focusing in two planes (i.e., sagittal focusing) was desired, the crystals were bent laterally either using a four-bar fixture or by attaching fixed supports to two opposing ends of the crystal that would apply bending forces to the crystal through its rigid supports. Good focusing was therefore obtained in one plane, and due to the anticlastic shape that occurs naturally from lateral bending due to Poisson strain, some focusing in the meridional direction resulted. Those photons impacting the crystal from the radiation source that were not adequately focused in the meridional direction therefore made no contribution to the delivered photon brightness and were unfortunately discarded.

Moreover, while anticlastic curvature in the transverse direction (see "Spatially Resolved Poisson Strain and Anticlastic Curvature Measurements in Si Under Large Deflection Bending" by W. Yang, B. C. Larson, G. E. Ice, J. z. Tischler, J. D. Budai and K.-S. Chung of Oak Ridge National Laboratory, published in the Jun. 2, 2003 issue of Applied Physics Letters) results from inherent transverse shear forces and Poisson strain, this anticlastic curvature only contributes to meridional focusing of X-rays due to Poisson strain. This results in a saddle shaped crystal that inefficiently focuses photons. To date, no specific attempt has been made to control focusing in both the sagittal and meridional directions by changing the bending and therefore the three-dimensional shape of the crystal in two axes simultaneously.

Accordingly, it would be desirable to provide an x-ray focusing device and a method for bending at least one crystal in two orthogonal axes, sequentially or simultaneously, to control a monochromator crystal and develop an optimized shape in three dimensions. By focusing in both the sagittal and meridional directions, the bending of the crystal can provide added brightness and photon flux from the same radiation source in comparison with the resultant focusing in the meridional direction that occurs with the natural anticlastic shape from single axis lateral bending due to Poisson strain. Furthermore, since focal distances may be different for each application, the ability to fine-tune the focal length as needed for specific applications allows this invention to be used in many different applications.

SUMMARY

An x-ray focusing device generally includes a frame, at least one clamping mechanism supported on the frame, a crystal for focusing x-rays held by the clamping mechanism, at least one first bending mechanism supported on the frame and at least one second bending mechanism supported on the frame. The first bending mechanism is engaged with the crystal for bending the crystal with respect to a first axis and the second bending mechanism is engaged with the crystal for bending the crystal with respect to a second axis, wherein the second axis is preferably orthogonal to the first axis.

In a preferred embodiment, the device includes two first bending mechanisms disposed on opposite lateral sides of the frame and two second bending mechanisms disposed on opposite longitudinal sides of the frame, wherein the first bending mechanisms are orthogonal to the second bending mechanisms. In this case, the device preferably includes four clamping mechanisms, wherein each of the clamping mechanisms is disposed between a first bending mechanism and a second bending mechanism. Also, the frame preferably has a generally rectangular planar shape and defines an opening in a center thereof, wherein the crystal is held by the clamping mechanism in the opening of the frame. Additional attachments (not shown) to the clamping mechanisms and/or, the silicon crystal may be used in alternative embodiments to provide cooling to the Laue crystal if needed.

The clamping mechanism preferably includes an upper clamp member, a lower clamp member attached to the upper clamp member, a fastener attached to the frame and engaged with one of the upper and lower clamp members and a spherical bearing disposed between the fastener and one of the upper and lower clamp members. The crystal is held between the upper and lower clamp members and the spherical bearing permits angular and rotational movement of the upper and lower clamp members with respect to the frame.

Each of the first and second bending mechanisms preferably includes an upper jaw member, a lower jaw member attached to the upper jaw member and a drive mechanism attached to the frame and one of the upper and lower jaw members. The crystal is disposed between the upper and lower jaw members and the drive mechanism translates the upper and lower jaw members in a direction perpendicular to the frame, thereby bending the crystal. In this case, each of the upper and lower jaw members preferably includes a crystal contact surface having a convex curvature for engagement with the crystal, wherein the crystal is disposed between the convex crystal contact surface of the upper and lower jaw members.

In a preferred embodiment, the drive mechanism for the bending mechanism includes a reversible motor attached to the frame, a rotatable drive member driven by the motor and a bearing provided in one of the upper and lower jaw members. The bearing engages the rotatable drive member such that the upper and lower jaw members are linearly translated along the axis of the drive member upon rotation of the drive, member. In this embodiment, the motor is preferably a piezoelectric translator.

In an alternative embodiment, the drive mechanism for the bending mechanism includes a threaded set screw rotatably coupled to the frame and a threaded bearing provided in one of the upper and lower jaw members. The threaded bearing threadably engages the rotatable threaded set screw such that the upper and lower jaw members are linearly translated along the axis of the threaded set screw upon rotation of the threaded set screw. This alternative embodiment provides the option for manually translating the bending mechanism.

A method for focusing an x-ray beam generally includes the steps of directing an x-ray beam through a crystal and bending the crystal with respect to two axes to focus the x-ray beam in two directions, wherein the two axes are preferably orthogonal to each other.

In a preferred embodiment, the step of bending the crystal includes the steps of clamping the crystal within a frame with at least one clamping mechanism, bending the crystal about a first axis with at least one first bending mechanism supported on the frame and bending the crystal about a second axis with at least one second bending mechanism supported on the frame. Preferably, the crystal is bent by two first bending mechanisms disposed on opposite lateral sides of the frame and two second bending mechanisms disposed on opposite longitudinal sides of the frame, wherein the first bending mechanisms are orthogonal to the second bending mechanisms. Also, the crystal is preferably clamped by four clamping mechanisms, wherein each of the clamping mechanisms is disposed between a first bending mechanism and a second bending mechanism.

The preferred embodiments of the x-ray focusing device, as well as other objects, features and advantages, will be apparent from the following detailed description, which is to be read in conjunction with the accompanying drawings. The scope will be pointed out in the claims.

DETAILED DESCRIPTION OF THE PREFERRED EMBODIMENTS

In general, the subject device uses sagittally and meridionally bent asymmetric Laue crystals to achieve both horizontal and vertical focusing of x-ray beams. The physics behind sagittal focusing with a sagittally bent asymmetric Laue crystal 12 is shown in FIGS. 1-7 and explained in detail in Zhong et al., "Sagittal Focusing of High-Energy Synchrotron X-rays with Asymmetric Laue Crystals I: Theoretical Considerations," *Journal of Applied Crystallography*, ISSN 0021-8898, Vol. 34, pp. 504-509 (2001) and Zhong et al., "Sagittal Focusing of High-Energy Synchrotron X-rays with Asymmetric Laue Crystals II: Experimental Studies," *Journal of Applied Crystallography*, ISSN 0021-8898, Vol. 34, pp. 646-653, (2001), both of which are incorporated herein by reference.

As explained in these papers, it has been found that sagittally bending an asymmetric Laue crystal creates a focusing device which can be used to advantageously focus a divergent beam of x-rays. As used herein, the term "sagittally bent" means that the crystal is horizontally or vertically bent from an initial flat planar orientation to a curved orientation. The term "asymmetric" refers to a crystal whose lattice planes are not normal to the incident crystal surface. Thus, FIGS. 1-6 show such a crystal 12 (bent horizontally) diffracting a horizontal x-ray fan beam 14. Because of the sagittal bending, the diffraction vector H of the crystal 12 along the fan beam 14 precesses around the axis of sagittal bending, thus focusing the diffracted beam 16.

Figure 1:
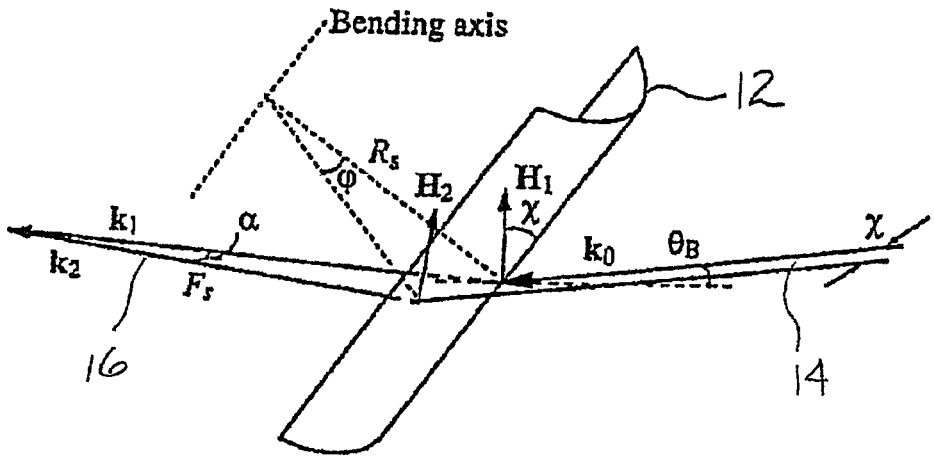
FIG. 1 is a real-space diagram showing two parallel incident x-ray beams being monochromatized and sagittally focused at a focal distance of F.
Figure 2:
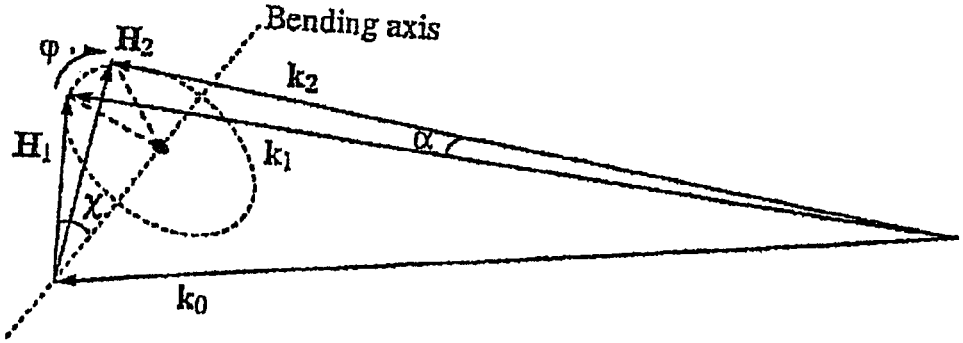
FIG. 2 is a reciprocal-space diagram of FIG. 1 showing the precession of the diffraction vectors $H_1$ and $H_2$ around the axis of sagittal bending, and the resulting angle $\alpha$ between wave vectors $k_1$ and $k_2$ of the diffracted beams.
Figure 3:
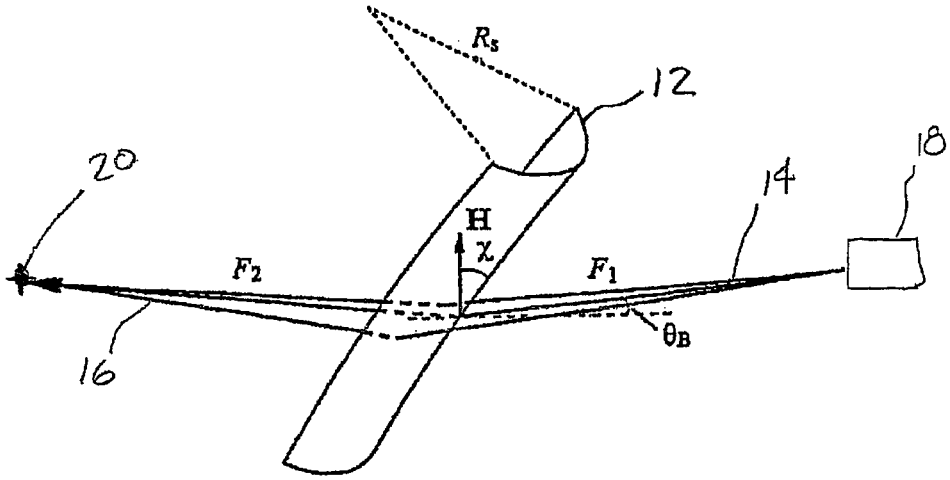
FIG. 3 is a side view of a single sagittally bent Laue crystal focusing a diverging horizontal fan-shaped beam.
Figure 4:
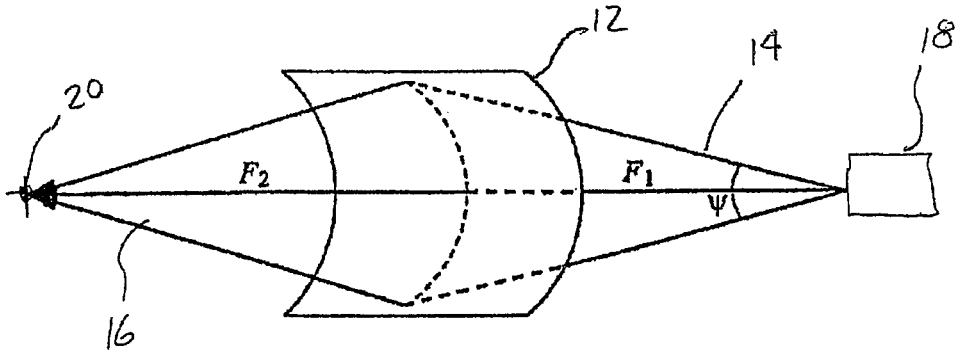
FIG. 4 is a top view of the Laue crystal shown in FIG. 3.

FIGS. 1 and 2 depict the change (in the plane perpendicular to the scattering plane) of the direction of the diffracted x-rays in real and reciprocal space. Two incident x-ray beams are considered and assumed to be parallel, with wave vector $k_0$. The first beam strikes the center of the crystal and is diffracted by the diffraction vector $H_1$ into a direction indicated by $k_1=k_0+H_1$. The second beam is in the same horizontal plane as the first one, at a distance x from it. At the point where the second X-ray beam meets the crystal, the crystal's diffraction vector, $H_2$, precesses by an angle $\phi$ around the axis of sagittal bending. This causes a change, $\alpha$, of the direction of the diffracted X-rays of the second beam ($k_2=k_0+H_2$) with respect to those of the first beam. The change, $\alpha$, is perpendicular to the diffraction plane for a small $\phi$.

The magnitudes of $\phi$ and $\alpha$ are related to $\Delta H=|H_1-H_2|$ and x by $$\Delta H=2H\sin\chi\sin(\phi/2)=2k\sin(\alpha/2) \quad (1)$$

and $$x=R_s\sin\phi, \quad (2)$$

where H is the magnitude of the diffraction vectors $H_1$ and $H_2$, k is the magnitude of the wave vectors $k_0$, $k_1$ and $k_2$, $R_s$ is the radius of the sagittal bending, $\chi$ is the asymmetry angle defined as the angle between the crystal surface normal and the Bragg planes used for reflecting the x-rays, and x is the horizontal width of the incident beam.

Using equations (1) and (2), and $H-2k\sin\theta_B$, the sagittal focal length $F_s=x/\alpha$ is calculated:

$$F_s=\pm R_s/2\sin\theta_B\sin\chi, \quad (3)$$

where $\theta_B$ is the Bragg angle of reflection. The upper sign is used ($F_s$ is positive) if the diffraction vector is on the same side of the crystal as the center of the sagittal bending, i.e., the diffraction vector is on the concave side of the sagittally bent crystal, thereby focusing the x-rays. The situations shown in FIGS. 1-4 correspond to this case. $F_s$ is negative (lower sign) if the diffraction vector is on the convex side of the crystal, causing further divergence of the horizontal x-rays.

Equation (3) can be compared with that of the focal length of a sagittally focusing symmetric Bragg crystal, $F_{Bragg}=R_s/(2\sin\theta_B)$. The focal length of a sagittal Laue crystal is a factor of $1/\sin\chi$ longer (typically a factor of 1.5 to 2) than that of a Bragg crystal bent to the same radius.

Equation (3) shows that the sagittal focal length is infinity when the asymmetry angle is zero. Thus, a symmetrical Laue crystal does not have any sagittal focusing effect. This can be easily understood by considering the diffraction vectors $H_1$ and $H_2$ in FIGS. 1 and 2. The diffraction vectors would all point along the bending axis of the crystal, regardless of their positions, so that there would be no change in the direction of the diffracted x-rays in the sagittal plane.

Utilization of a Laue crystal 12 differs from the prior art Bragg reflection crystals in that the x-rays pass through the body of the crystal and are diffracted, rather than being reflected from a surface. At high energies, the incidence angle for the x-rays becomes very small. For the Bragg crystal, this implies a large illuminated crystal area, thereby placing serious constraints on the tolerance of optical figure efforts. In the Laue crystal 12, the beams are almost perpendicular to the surface, and so the illuminated area is small and essentially unaffected by changes in energy.

Figure 5:
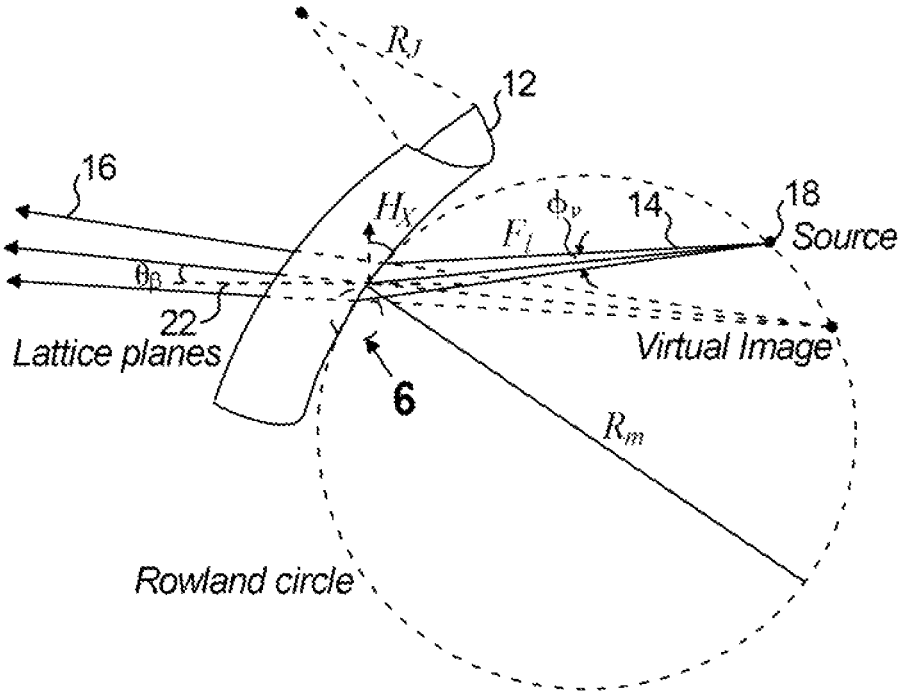
FIG. 5 shows the arrangement of inverse-Cauchois geometry in the meridional plane to take advantage of the anticlastic bending of a sagittally bent asymmetric Laue crystal.
Figure 6:
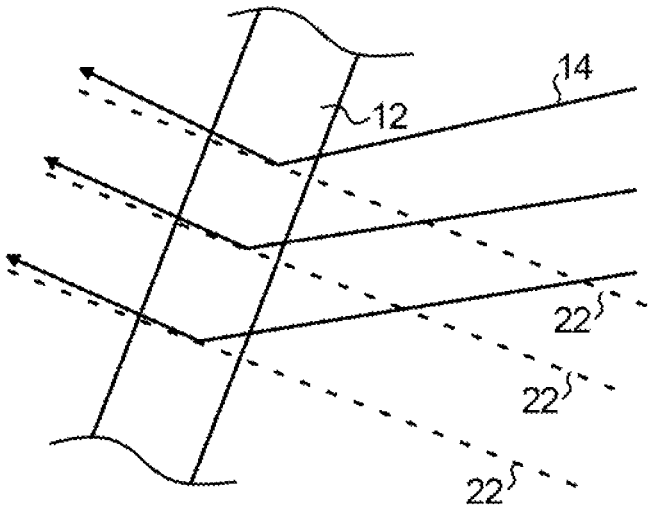
FIG. 6 is an enlarged cross-sectional view of the Laue crystal shown in FIG. 5 showing the x-ray beams being diffracted by the lattice planes of the crystal.
Figure 7:
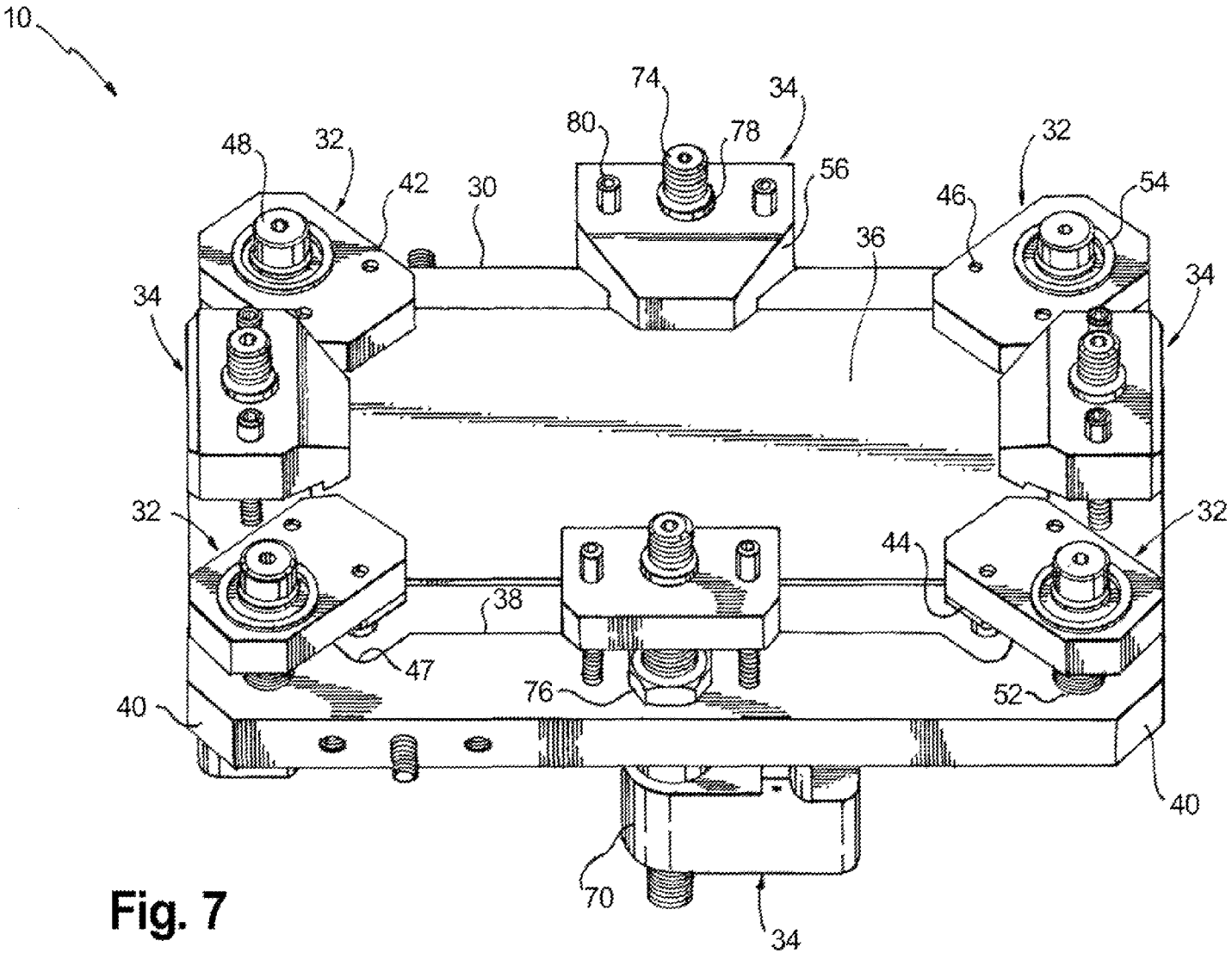
FIG. 7 is a top perspective view of the two-axis focusing device.
Figure 8:
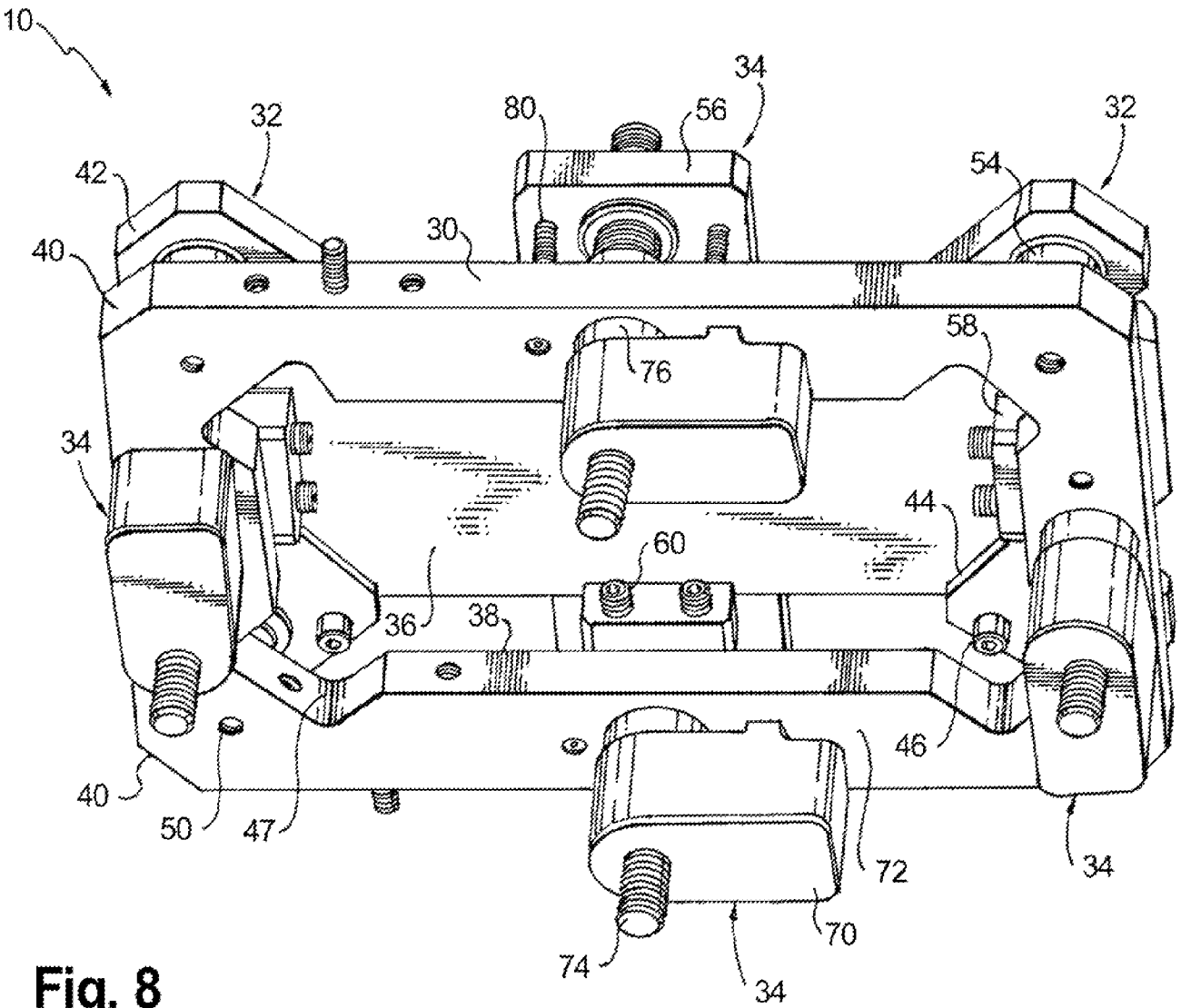
FIG. 8 is a bottom perspective view of the device shown in FIG. 7.

FIGS. 3-6 show a Laue crystal 12 sagittally focusing a diverging horizontal fan-shaped x-ray beam 14 from a synchrotron x-ray source 18, wherein F1 and F2 are the distances from the source to the crystal and the distance from the crystal to the focal point 20, respectively. As can be seen in FIGS. 5 and 6, the x-ray beam 14 passing through the Laue crystal 12 is reflected by the lattice planes 22 causing the beam to be diffracted, while the curvature of the crystal simultaneously converges the beam.

As mentioned above, the present device and method involves bending a Laue crystal in both a sagittal, as well as a meridional direction to provide x-ray focusing in both a horizontal and a vertical direction. Thus, as shown in FIGS. 7-13, the two-axis focusing device 10 generally includes a frame 30, four clamping mechanisms 32 supported on the frame and four bending mechanisms 34 also supported on the frame. In general, a crystal 36 is held within the frame 30 at four locations by the clamping mechanisms 32 and is bent in two axes by the bending mechanisms 34.

Laue crystals (e.g. silicon wafers) used in such monochromator focusing applications are typically provided in a rectangular sheet form. Accordingly, in a preferred embodiment, the frame 30 has a generally rectangular planar shape and defines a generally rectangular opening 38 in the center thereof. The crystal 36 is preferably held in the opening 38 of the frame 30 by the clamping mechanisms 32 at four orthogonal locations. More particularly, the clamping mechanisms 32 are positioned on the corners 40 of the frame to clamp the crystal 36 at its corners along the periphery of the crystal.

Figure 12:
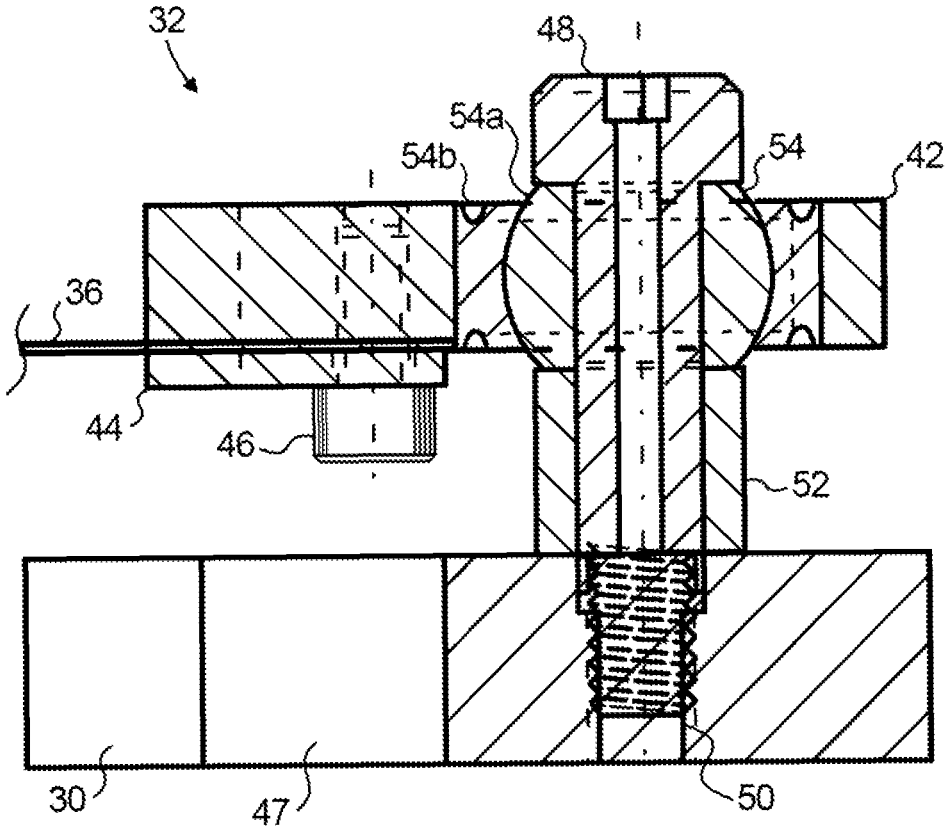
FIG. 12 is a cross-sectional view of the device shown in FIG. 9, taken along line C-C.

Referring particularly to FIG. 12, each clamping mechanism 32 includes an upper clamp member 42 and a lower clamp member 44 attached to the upper clamp member 42 by at least one fastener 46. The crystal 36 is held between the upper clamp member 42 and the lower clamp member 44 by tightening the fastener 46.

Figure 9:
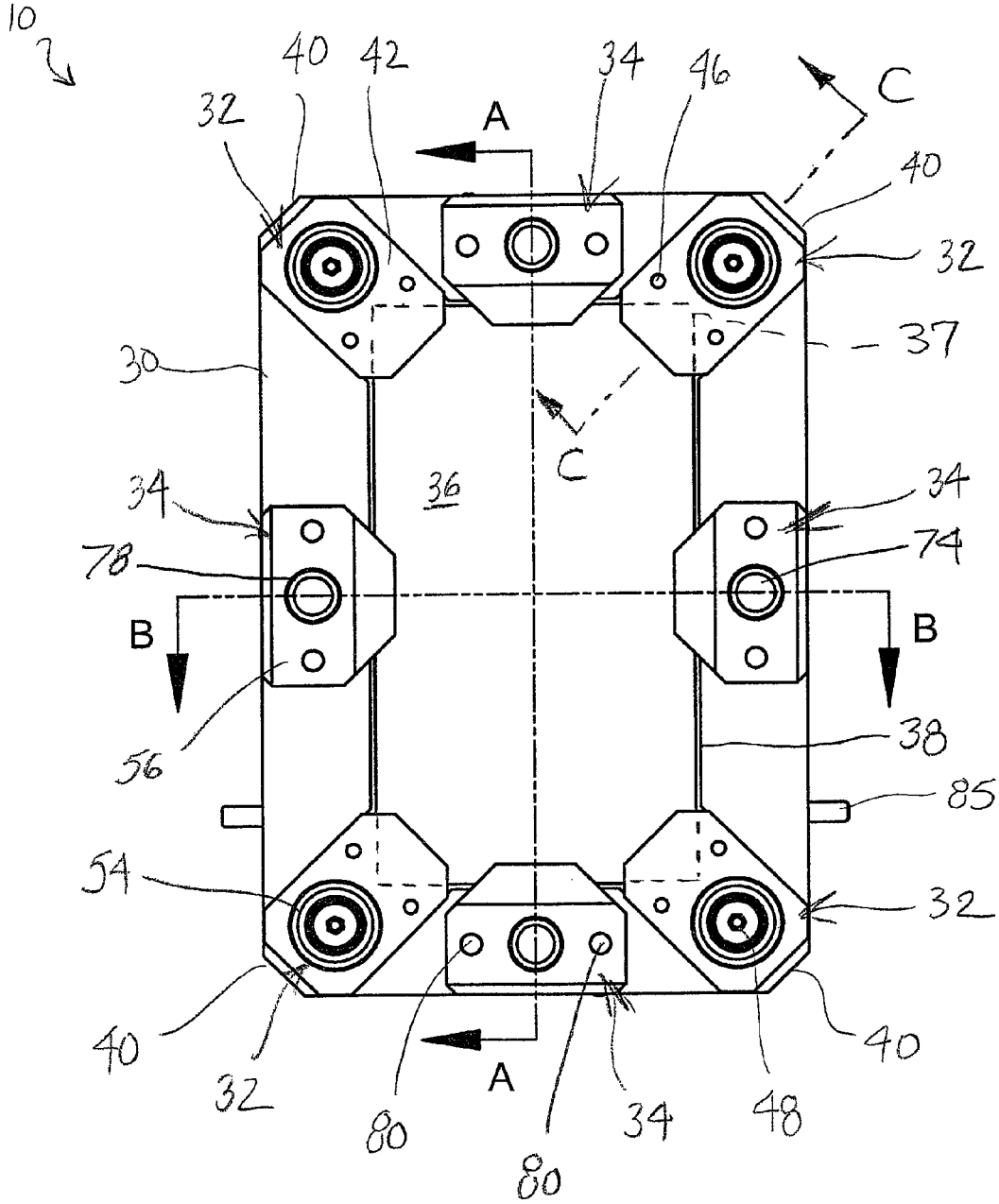
FIG. 9 is a top plan view of the device shown in FIG. 7.

Preferably, two fasteners 46 are provided for clamping the upper clamp member 42 and the lower clamp member 44 together, as shown more clearly in FIG. 9. The two fasteners 46 are preferably spaced apart from each other and are located so as to enable the corner 37 of the crystal 36 to be positioned between the fasteners and held securely by the clamp members 42, 44. Clearance cut-outs 47 are preferably formed in the frame 30 to provide access to the fasteners with a suitable tool from beneath the frame, as shown in FIG. 12.

At least one of the clamp members 42, 44 is attached to the frame 30 by a fastener. In the preferred embodiment shown in the drawings, the upper clamp member 42 is attached to the frame via a threaded shoulder bolt 48 received within a threaded hole 50 provided on the frame 30. A spacer 52 is preferably provided around the shoulder bolt 48 between the frame 30 and the upper clamp member 42 to space the clamping members 42, 44, and hence the crystal 36, a desired distance from the frame 30.

The strength or force to grip the crystal 36 needs to be sufficient to counteract the pulling forces created when the crystal is bent. Therefore, the clamping mechanisms 32 grip the monochromator crystal 36 in a way that allows the crystal to deform without breaking it. To achieve this, in a preferred embodiment, a spherical bearing 54 is provided between the shoulder bolt 48 and the upper clamping member 42. The spherical bearing 54 includes a spherical member 54*a* having a through-hole to receive the shoulder bolt in close fitting relationship. The spherical member 54*a* is pivotably retained within a bushing 54*b*, which is secured in the upper jaw member 42. Thus, the spherical bearing permits angular and rotational movement of the upper and lower clamping members 42, 44 so as to allow a full range of bending of the crystal 36 without breaking the corners of the crystal.

Figure 12A:
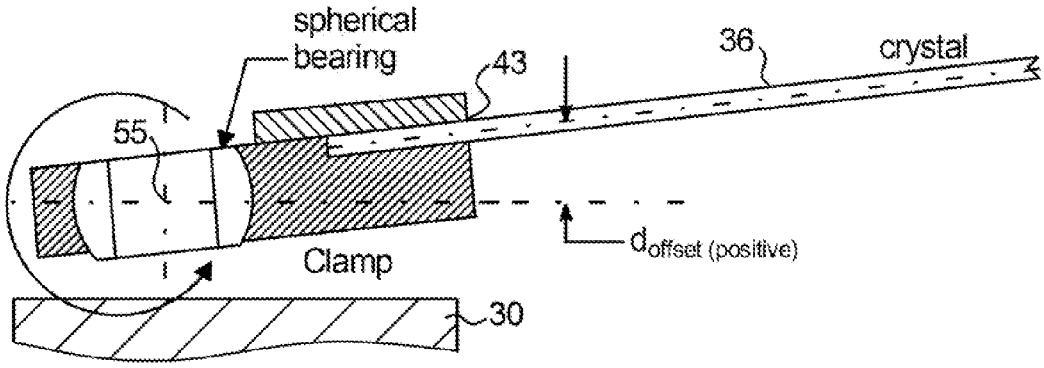
FIGS. 12*a*, 12*b* and 12*c* are schematic cross-sections of three variants of the clamping mechanism, with the preferred variant shown in FIG. 12*c*.
Figure 12B:
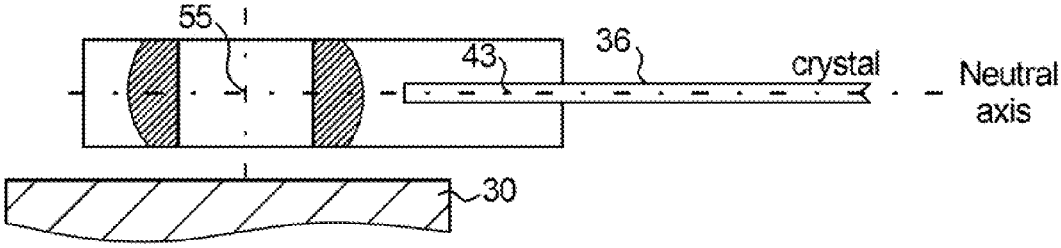

To further prevent damage to the crystal 36 during bending, the components of the clamping mechanisms 32 are arranged in a manner to minimize strain to the crystal. In particular, FIG. 12*a* shows an arrangement wherein the upper and lower clamping members 42, 44 are reversed with respect to the frame 30, as compared with FIG. 12. In this case, the upper and lower clamp members define a clamping gap 43 for receiving and retaining the crystal 36, which is spaced in a "positive" direction with respect to the frame 30 and the center 55 of the spherical bearing 54. Thus, a positive offset of the crystal 36 is formed. Assuming that the clamping members do not allow the crystal 36 to slip, it can be appreciated that the arrangement of FIG. 12*a*, in which a positive offset is formed, will result in the crystal being pulled in tension as the crystal deflects upon bending. Even if the clamping gap 43 is aligned with the center 55 of the bearing, thereby creating a neutral offset of the crystal 36, there will still be a tendency to strain the crystal upon bending.

However, by orienting the upper and lower clamping members in a manner in which the clamping gap 43 is positioned between the frame 30 and the center 55, thereby creating a "negative" offset, the strain on the crystal during bending is significantly reduced. Specifically, by providing a negative offset for the clamping gap 43, the crystal 36 will allow the clamping mechanisms 32, as a whole, to move slightly toward each other as bending occurs, thereby reducing the tendency to strain the crystal. Thus, the present device sets the distance of the negative offset to allow this compensating motion to occur.

As mentioned above, bending of the crystal 36 in two axes is accomplished by the bending mechanisms 34. Returning to FIGS. 7-11, the bending mechanisms 34 are supported on the same side of the frame 30 as the clamping mechanisms 34 and are disposed at four orthogonal locations between the clamping mechanisms 32 to engage the peripheral sides of the crystal 36. Preferably, the bending mechanisms 32 are positioned on the frame 30 so as to engage the crystal at the approximate mid-point of each side of the rectangular crystal.

Figure 10:
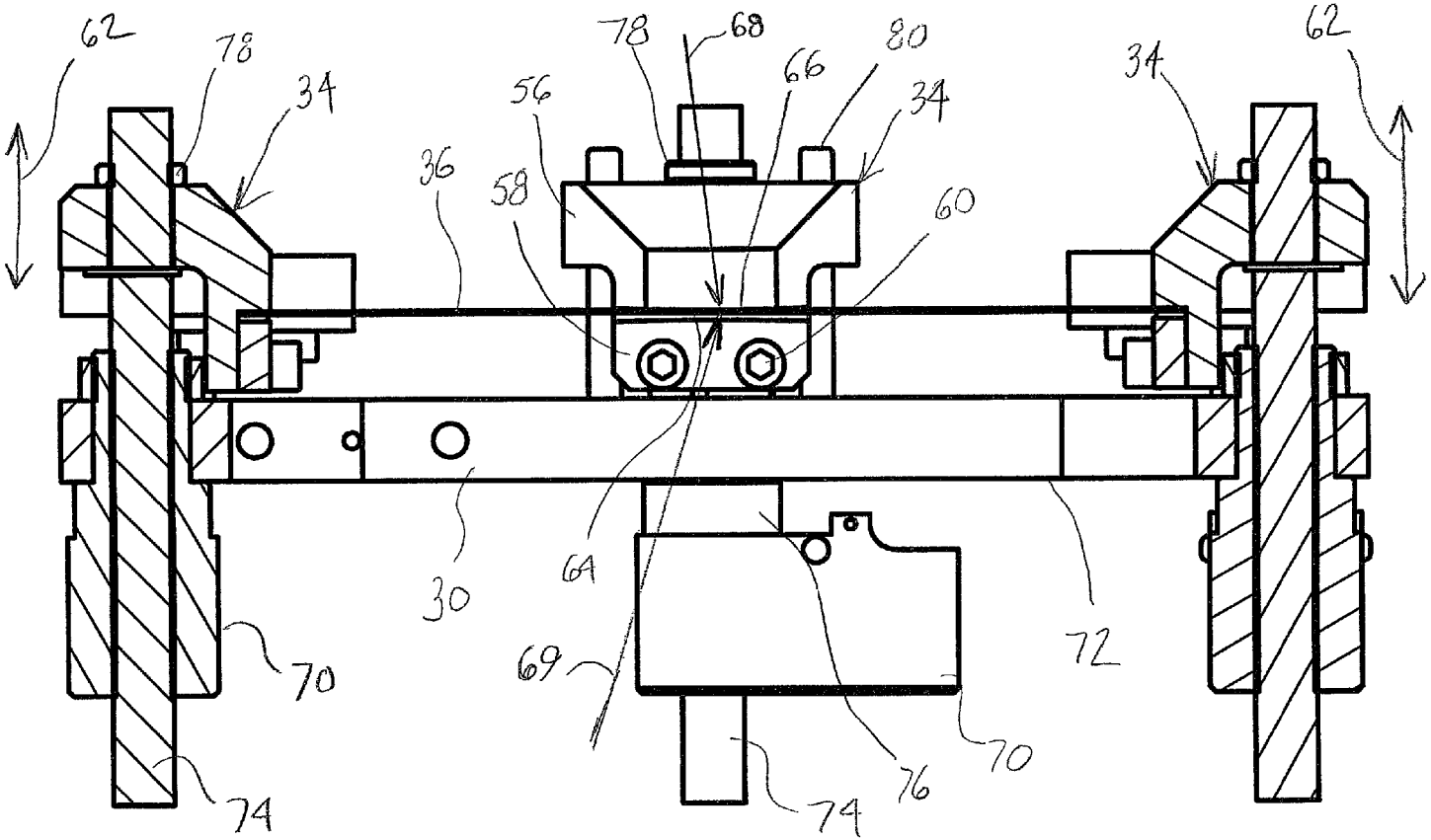
FIG. 10 is a cross-sectional view of the device shown in FIG. 9, taken along line A-A.
Figure 11:
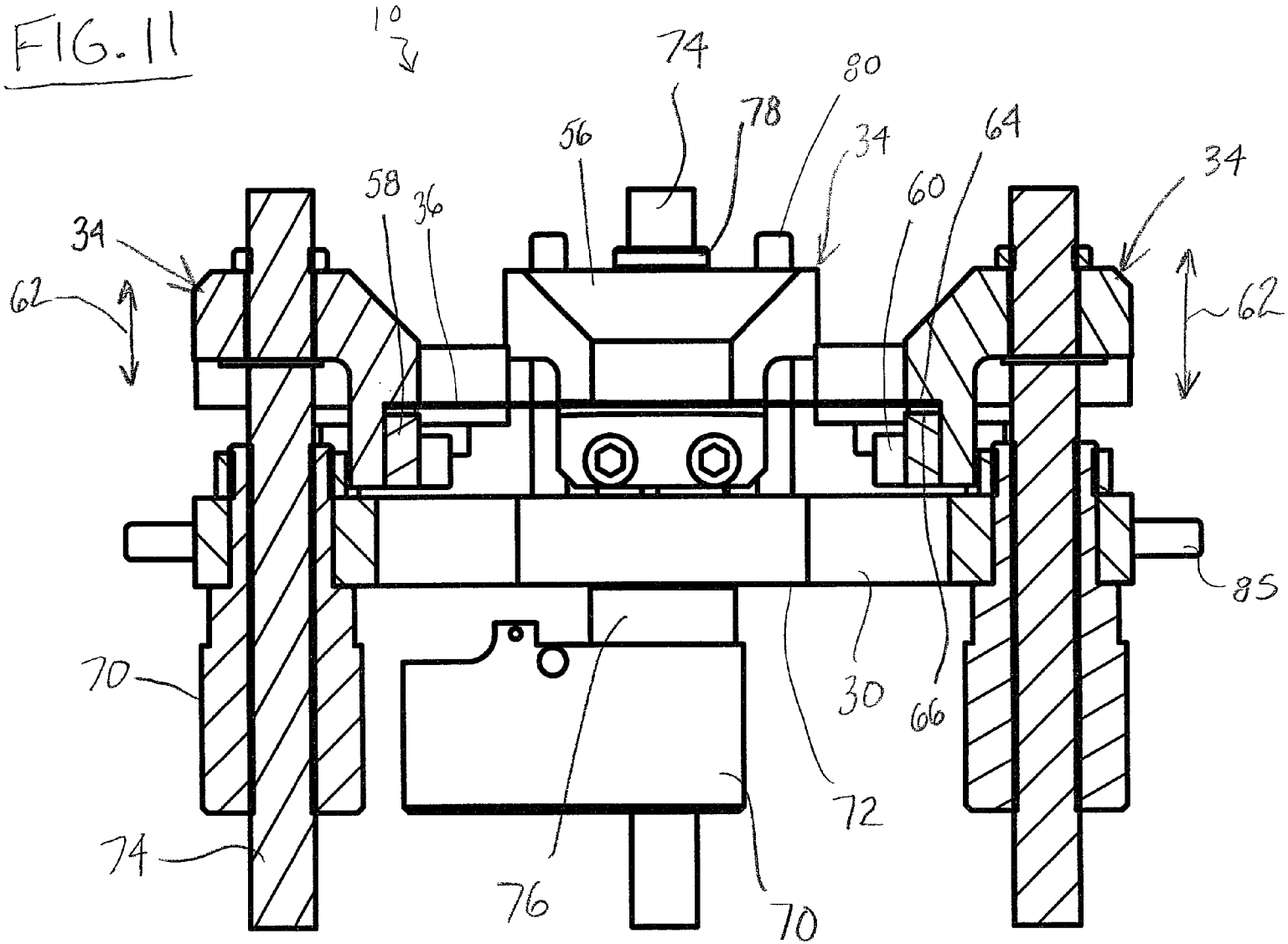
FIG. 11 is a cross-sectional view of the device shown in FIG. 9, taken along line B-B.

Like the clamping mechanisms 32, each bending mechanism 34 includes an upper jaw member 56 attached to a lower jaw member 58 via fasteners 60 for retaining the crystal 36 there between, as shown in FIG. 10. In this case, however, since the bending mechanisms 34 hold the lateral edges of the crystal 36, the axes of the fasteners 60 must be oriented parallel to the crystal so as not to interfere with the crystal: Again, two fasteners 60 are preferably provided for securing the upper jaw member 56 and the lower jaw member 58 together, with the edge of the crystal 36 being disposed between the upper and lower jaw members. The upper and lower jaw members 56, 58 are preferably made from beryllium copper to better transfer heat.

Figure 12C:
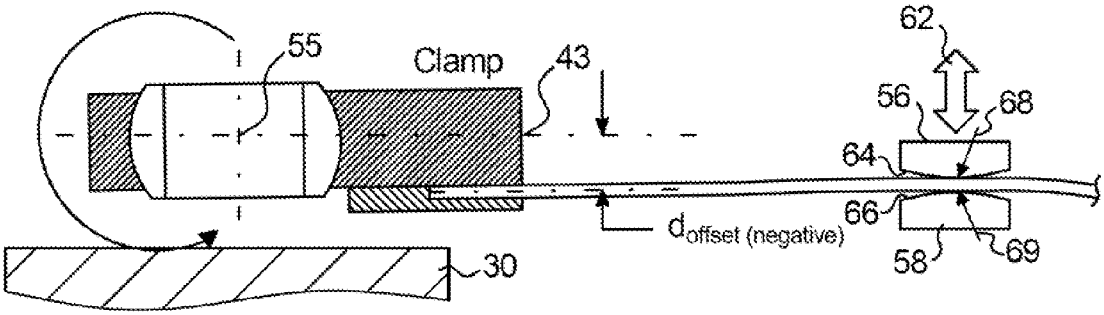

As will be described in further detail below, the upper jaw member 56 and the lower jaw member 58 are, together, movable in a direction perpendicular to the plane of the frame 30 to bend the crystal with respect to two axes. The direction of movement of the jaw members 56, 58 is indicated by the arrow 62 shown in FIGS. 10, 11 and 12*c*.

To prevent the jaw members 56, 58 from damaging the crystal 36 during bending, the upper jaw member 56 and the lower jaw member 58 are preferably provided with respective convex contact surfaces 64, 66. As more specifically shown in FIG. 10*a*, and in an exaggerated form in FIG. 12*c*, the contact surface 64 of the upper jaw member 56 preferably has a radius of curvature 68 of about 1 meter and the contact surface 66 of the lower jaw member 58 preferably has an opposite radius of curvature 69 of about 1 meter. It has been found that a radius of curvature of about 1 meter generally matches the maximum amount of bending of the crystal 36. Such opposite convex contact surfaces 64, 66 eliminates sharp corners on the jaw members 56, 58, which could damage the crystal upon bending.

The jaw members 56, 58 can be made from any durable material that is vacuum compatible and capable of transferring heat. The jaw members 56, 58 can be made from an elastic material, in which case the convex contact surfaces 64, 66 may no longer be needed so that the jaw members can take any desired shape.

As mentioned above, the jaw members 56, 58 are linearly translatable with respect to the frame 30 in a direction perpendicular to the plane of the frame. Thus, as shown in the drawings, when the jaw members 56, 58 are linearly translated in a direction away from the frame, the convex contact surface 66 of the lower jaw member 58 engages the bottom surface of the crystal 36 to bend the crystal outwardly with respect to the frame 30. Conversely, when the jaw members 56, 58 are linearly translated in a direction toward the frame, the convex contact surface 64 of the upper jaw member 56 engages the top surface of the crystal 36 to bend the crystal inwardly with respect to the frame 30.

Such linear translation is preferably accomplished with piezo-electric translators 70, although other drive devices, such as stepper or servo motors, can be utilized. In particular, each bending mechanism 34 preferably includes a piezoelectric translator 70 for driving the upper and lower jaw members 56, 58. The piezo-electric translator 70 is preferably attached to the bottom side 72 of the frame 30 opposite the upper and lower jaw members 56, 58. The piezo-electric translator 70 is provided with a drive member, in the form of a threaded lead screw 74, which extends through the frame for engagement with the upper jaw member 56. In this regard, the frame 30 is preferably provided with a bearing 76 for rotatably supporting the lead screw 74 of the piezo-electric translator 70.

The upper jaw member 56 is preferably provided with a threaded bearing 78, which engages the threaded lead screw 74 such that rotation of the lead screw will translate the upper jaw member 56 in a linear direction along the axis of the lead screw. To ensure precise linear movement, two guide pins 80 are preferably press-fit into the frame 30 and are received in the upper jaw member in close sliding relationship.

As can be appreciated, activation of the piezo-electric translator 70 will rotate the threaded lead screw 74. Since the lead screw 74 is threadably engaged with the threaded bearing 78 of the upper jaw member 56, rotation of the lead screw 74 will cause the upper jaw member 56 to translate in a direction perpendicular to the plane of the frame 30. With the crystal 36 securely held between the upper jaw member 56 and the lower jaw member 58, while at the same time being fixed to the clamping mechanisms 32 at its corners, linear translation of the upper jaw member 56 will cause the crystal to bend.

Figure 13:
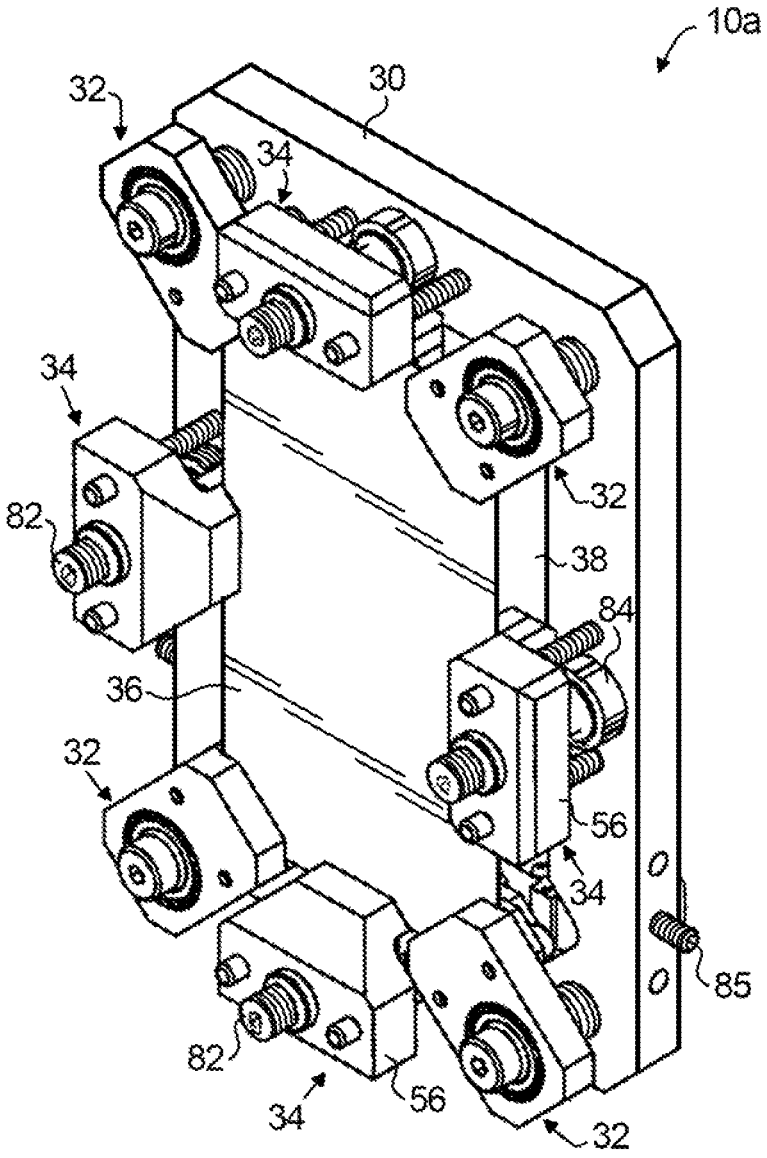
FIG. 13 is a top perspective view of an alternative embodiment of the two-axis focusing device.

FIG. 13 shows an alternative embodiment of the device 10*a* wherein the piezo-electric translators 70 have been replaced with threaded set screws 82, which are rotated manually for linearly translating the upper jaw member. In this case, the set screws 82 are rotatably attached to the frame 30 via a bearing 84 and the set screws 82 can be rotated by hand with a suitable tool to linearly translate the upper jaw member, in either direction orthogonal to the face of the undeformed crystal 36.

In both embodiments, three-dimensional deformation of the crystal 36 occurs when the linear translators 70, 82 move the upper and lower jaw members 56, 58 toward or away from the frame 30. The crystal 36 can be thus deformed in two orthogonal axes. In a preferred embodiment, opposite pairs of upper and lower jaw members 56, 58 are moved simultaneously to more accurately define the desired saddle shape of the bent crystal where the radius along one dimension is smaller than the radius along the other dimension.

The two-axis focusing device 10, 10*a* will generally be used within a larger assembly that may also include a vacuum vessel and kinematic mounts or supports to allow the monochromator crystal 36 to be translated and/or rotated as needed to assure that the crystal is located at the appropriate position and orientated within the monochromator so that it can focus photons at the appropriate location. Since the device 10, 10*a* will typically reside inside a vacuum vessel, a means of activating and controlling the linear and/or rotary actuators 70, 82 will be needed to control the linear motion for each translation means so that the crystal 36 deforms in a controlled manner.

It would also be desirable to provide a means for transferring heat away from the focusing device 10, 10*a* when supported within such a vacuum vessel. A means for transferring heat through radiation may involve the positioning of one or more heat sinks within the vacuum vessel adjacent the focusing device 10, 10*a* to absorb head radiated from the device.

A means for transferring heat by conduction may involve the provision of one or more heat conducting elements in direct contact with the device 10, 10*a*. For example, copper braids can be mechanically attached to heat dissipating members 85 provided on the frame 30 of the device. The opposite ends of such copper braids, in turn, can be mechanically attached to structural heat-sink elements of the vacuum vessel in order to transfer heat from the frame by conduction. Conventional water cooling lines can also be utilized to transfer heat by conduction.

It is also conceivable that a plurality of the two-axis focusing devices 10, 10*a* could be used in combination. For example, monochromators may utilize more than one crystal and may contain other devices in any combination such as one or more filters, beamstops, mirrors, apertures, collimators according to the needs of the specific application. All of these additional devices have specific purposes to assist and/or provide collimated, directed photons of the particular wavelengths needed for the individual scientific or industrial application. The core component (or components) that produce(s) monochromatic photons is/are the monochromator crystal(s). At least one monochromator crystal is needed in each monochromator. Therefore, a variant could include one or more additional crystals and/or mirrors, and any combination of the other devices indicated above.

The efficiency of the monochromator is largely determined by the amount of transmission and focusing that the monochromator can provide, that is, useful output energy/input energy. The device and method described herein provides high efficiency at low cost for hard x-rays.

The two-axis focusing device 10, 10*a* provides the ability to control bending of a crystal in two orthogonal axes. As a result, an additional benefit of at least one order of magnitude is achieved when meridional focusing and sagittal focusing is optimized for a specific monochromator application. The development of two-axis bending therefore inexpensively adds significant additional photon, flux and brightness from the same radiation source. This therefore involves both the method of controlling a monochromator crystal to develop an optimized shape in three dimensions, as well as the implementation of how to do so accurately and cost effectively.

Previously, two axis bending was not used for monochromator crystals. Thus, photons from an expensive radiation source that could be focused appropriately, and those that could not be adequately focused in the meridional direction were not used. The proposed device and method therefore provides added brightness from the same radiation source.

Although preferred embodiments of the present device and method have been described herein with reference to the accompanying drawings, it is to be understood that the herein device and method are not limited to those precise embodiments and that various other changes and modifications may be affected herein by one skilled in the art without departing from the scope or spirit of the invention, and that it is intended to claim all such changes and modifications that fall within the scope of the invention.

The invention claimed is:

1. An x-ray focusing device comprising:

a frame;

at least one clamping mechanism supported on said frame;

a crystal for focusing x-rays held by said clamping mechanism;

at least one first bending mechanism supported on said frame, said first bending mechanism being engaged with said crystal for bending said crystal with respect to a first axis; and at least one second bending mechanism supported on said frame, said second bending mechanism being engaged with said crystal for bending said crystal with respect to a second axis.

2. An x-ray focusing device as defined in claim 1, wherein said second axis is orthogonal to said first axis.

3. An x-ray focusing device as defined in claim 1, comprising two first bending mechanisms disposed on opposite lateral sides of said frame and two second bending mechanisms disposed on opposite longitudinal sides of said frame, said first bending mechanisms being orthogonal to said second bending mechanisms.

4. An x-ray focusing device as defined in claim 3, comprising four clamping mechanisms, each of said clamping mechanisms being disposed between a first bending mechanism and a second bending mechanism.

5. An x-ray focusing device as defined in claim 1, wherein said frame has a generally rectangular planar shape and defines an opening in a center thereof, said crystal being held by said clamping mechanism in said opening of said frame.

6. An x-ray focusing device as defined in claim 1, wherein said clamping mechanism comprises:

an upper clamp member;

a lower clamp member attached to said upper clamp member, said crystal being held between said upper and lower clamp members;

a fastener attached to said frame and engaged with one of said upper and lower clamp members; and a spherical bearing disposed between said fastener and said one of said upper and lower clamp members for permitting angular and rotational movement of the upper and lower clamp members with respect to said frame.

7. An x-ray focusing device as defined in claim 1, wherein each of said first and second bending mechanisms comprises:

an upper jaw member;

a lower jaw member attached to said upper jaw member, said crystal being disposed between said upper and lower jaw members; and a drive mechanism attached to said frame and one of said upper and lower jaw members for translating said upper and lower jaw members in a direction perpendicular to said frame, thereby bending said crystal.

8. An x-ray focusing device as defined in claim 7, wherein each of said upper and lower jaw members comprises a crystal contact surface having a convex curvature for engagement with said crystal, said crystal being disposed between said convex crystal contact surfaces of said upper and lower jaw members.

9. An x-ray focusing device as defined in claim 7, wherein said drive mechanism comprises:

a motor attached to said frame;

a rotatable drive member driven by said motor; and a bearing provided in one of said upper and lower jaw members, said bearing being engaged with said rotatable drive member for linearly translating said upper and lower jaw members along the axis of said drive member upon rotation of said drive member.

10. An x-ray focusing device as defined in claim 9, wherein said motor is a piezo-electric translator.

11. An x-ray focusing device as defined in claim 7, wherein said drive mechanism comprises:

a threaded set screw rotatably coupled to said frame; and a threaded bearing provided in one of said upper and lower jaw members, said threaded bearing being threadably engaged with said rotatable threaded set screw for linearly translating said upper and lower jaw members along the axis of said threaded set screw upon rotation of said threaded set screw.

12. A method for focusing an x-ray beam comprising the steps of:

directing an x-ray beam through a crystal; and bending the crystal with respect to two axes to focus the x-ray beam in two directions.

13. A method for focusing an x-ray beam as defined in claim 12, wherein the two axes are orthogonal to each other.

14. A method for focusing an x-ray beam as defined in claim 12, wherein the step of bending the crystal comprises the steps of:

clamping the crystal within a frame with at least one clamping mechanism;

bending the crystal about a first axis with at least one first bending mechanism supported on the frame; and bending the crystal about a second axis with at least one second bending mechanism supported on the frame.

15. A method for focusing an x-ray beam as defined in claim 14, wherein said crystal is bent by two first bending mechanisms disposed on opposite lateral sides of said frame and two second bending mechanisms disposed on opposite longitudinal sides of said frame, said first bending mechanisms being orthogonal to said second bending mechanisms.

16. A method for focusing an x-ray beam as defined in claim 15, wherein said crystal is clamped by four clamping mechanisms, each of said clamping mechanisms being disposed between a first bending mechanism and a second bending mechanism.

17. A method for focusing an x-ray beam as defined in claim 14, wherein said clamping mechanism comprises:

an upper clamp member;

a lower clamp member attached to said upper clamp member, said crystal being held between said upper and lower clamp members;

a fastener attached to said frame and engaged with one of said upper and lower clamp members; and a spherical bearing disposed between said fastener and said one of said upper and lower clamp members for permitting angular and rotational movement of the upper and lower clamp members with respect to said frame.

18. A method for focusing an x-ray beam as defined in claim 14, wherein each of said first and second bending mechanisms comprises:

an upper jaw member;

a lower jaw member attached to said upper jaw member, said crystal being disposed between said upper and lower jaw members; and a drive mechanism attached to said frame and one of said upper and lower jaw members for translating said upper and lower jaw members in a direction perpendicular to said frame, thereby bending said crystal.

19. A method for focusing an x-ray beam as defined in claim 18, wherein said drive mechanism comprises:

a motor attached to said frame;

a rotatable drive member driven by said motor; and a bearing provided in one of said upper and lower jaw members, said bearing being engaged with said rotatable drive member for linearly translating said upper and lower jaw members along the axis of said drive member upon rotation of said drive member.

20. A method for focusing an x-ray beam as defined in claim 18, wherein said drive mechanism comprises:

a threaded set screw rotatably coupled to said frame; and a threaded bearing provided in one of said upper and lower jaw members, said threaded bearing being threadably engaged with said rotatable threaded set screw for linearly translating said upper and lower jaw members along the axis of said threaded set screw upon rotation of said threaded set screw.

* * * * *